United States Patent [19]

Moore et al.

[11] Patent Number: 5,057,044

[45] Date of Patent: Oct. 15, 1991

[54] RECREATIONAL WATER SLED AND TOWING METHOD

[75] Inventors: Robert L. Moore, Orlando; Kevin L. Moore, Winter Park, both of Fla.

[73] Assignee: James M. Hoenstine, Orlando, Fla.

[21] Appl. No.: 542,097

[22] Filed: Jun. 22, 1990

[51] Int. Cl.[5] ..... B63B 35/81

[52] U.S. Cl. ..... 441/67; 114/246; 114/253; 441/69

[58] Field of Search ..... 441/65, 67, 72, 79, 441/69, 66; 114/281, 253, 246, 346

[56] References Cited

U.S. PATENT DOCUMENTS

| | | | |
|---|---|---|---|
| 2,359,366 | 10/1944 | Katcher et al. | 114/253 |
| 2,865,032 | 12/1958 | Moody | 441/72 |
| 2,958,875 | 11/1960 | McClain | 441/65 |
| 3,042,944 | 7/1962 | Basey et al. | 114/253 |
| 3,045,264 | 7/1962 | Smith | 441/67 |
| 3,434,167 | 3/1969 | Del Vecchio et al. | 441/67 |
| 3,953,905 | 5/1976 | Paitson | 114/253 |
| 4,798,157 | 1/1989 | Duret | 114/253 |

FOREIGN PATENT DOCUMENTS

| | | | |
|---|---|---|---|
| 2432326 | 4/1980 | France | 441/73 |

*Primary Examiner*—Sherman D. Basinger
*Assistant Examiner*—Thomas J. Brahan

[57] ABSTRACT

A recreational water sled and method for carrying a rider while being towed behind a boat includes a sled member and a downwardly-extending rudder, with a vertical steering pole extending approximately to chest height for a standing rider, and with a three point tow rope system, including a tow rope section attached to the upper extremity of the steering pole.

12 Claims, 5 Drawing Sheets

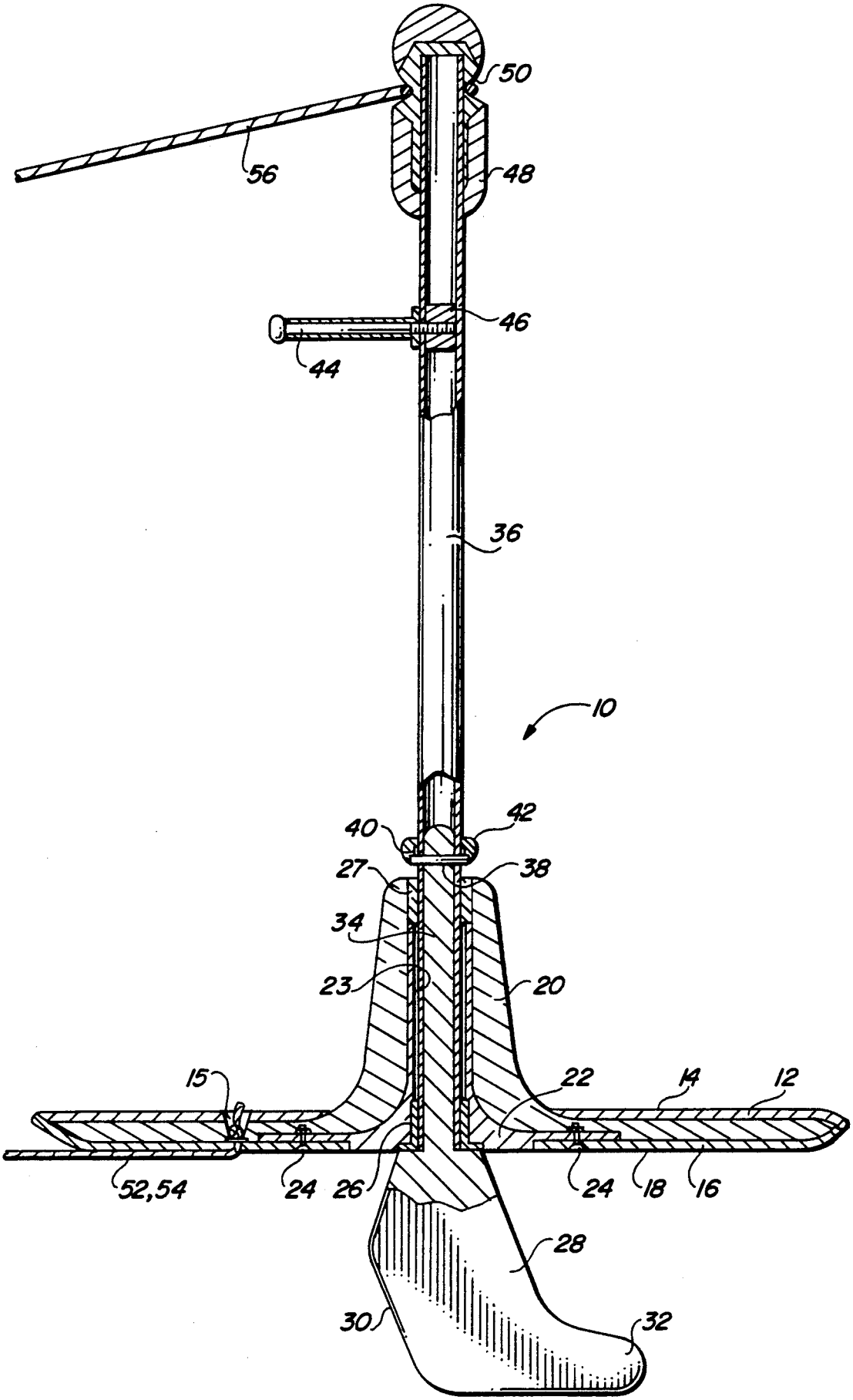
50
56
48
46
44
36
10
40
42
27
38
34
23
20
15
22
14
12
52,54
24
26
24
18
16
28
30
32

RECREATIONAL WATER SLED AND TOWING METHOD

BACKGROUND OF THE INVENTION

The present invention relates to recreational water devices, and in particular to water sleds which are designed to be towed behind a boat.

The prior art discloses a number of water sled arrangements with a mechanism for permitting the steering of the sled, and which are designed to be towed behind a ski boat. For example, in U.S. Pat. No. 2,910,708 to Albright, there is disclosed an elongated sled with a central seat, and with a stern-mounted rudder controlled by forward foot pedals. In U.S. Pat. No. 2,958,875, McClain discloses a delta-shaped water sled with an upstanding steering mechanism for controlling a central rudder, and with the delta-shaped sled including fixed stabilizing fins which permit tracking of the sled behind the towing boat.

Meehan, in U.S. Pat. No. 3,027,574 discloses a water ski having a steerable rudder controlled by an upstanding steering arm. U.S. Pat. No. 3,092,857 to Churchman teaches a water sled with a forward steerable rudder controlled by ropes, permitting the rider to either sit upon or stand on the sled.

More recently, Coleman in U.S. Pat. No. 4,756,700, taught a water recreational device consisting of a sled having an elongated member which permits the rider to stand upon the sled. Other prior art of interest includes U.S. Pat. No. 4,708,675 to Shoeffler et al.

SUMMARY OF THE INVENTION

The present invention is directed to a recreational water sled for carrying a rider while being towed behind a boat, and includes a sled member having a relatively flat surface lower surface and an upper surface for supporting a rider, with a rudder adjacent to and extending below the lower flat surface of the sled member. The sled includes a steering pole extending through the sled member and generally laterally with respect to the upper surface, the steering pole assembled at its lower end with the rudder, and extending at the upper end a substantial distance above the upper sled surface. Means are provided for towing the sled with a boat, the towing means including attachment means along the sled member and adjacent the upper end of the steering pole.

In a preferred embodiment, the towing means comprises first and second tow rope sections each joined to the sled member at attachment points which are spaced along the front of the sled member, and with a third tow rope section attached adjacent the upper end of the steering pole. Suitably, the first, second and third tow rope sections are joined together a substantial distance from the forward edge of the sled member a distance on the order of 10–20 feet. In order to accommodate the third tow rope section, A hub is provided as an attachment means at the upper end of the steering pole. It is also preferred that the sled member be provided with a stanchion extending centrally from the upper surface of the sled member with a hole extending therethrough, the steering pole and rudder assembly extending rotatably through the stanchion hole, and with bearing means between the stanchion and the steering pole and rudder assembly.

In the preferred embodiment, the water sled comprises a generally circular disc having a central core of a low density polymer so as to impart flotation characteristics to the disc. In the preferred form, the rudder extends along the lower surface of the sled, from the central hole through the stanchion.

The two rope system of the present invention significantly reduces the tendency of the water sled to rotate or oscillate, while stabilizing the water sled vertically. Further, the three point system with a vertical section transfers a part of the pulling force from the bottom of the water sled to the top of the steering pole, permitting the rider to lean significantly backwards, and enjoy a substantially different ride than would otherwise be obtainable on the prior art devices discussed above

THE DRAWINGS

FIG. 1 is a side view, partially in cross section, of a recreational water sled in accordance with the present invention.

FIGS. 1*a* and 1*b* are partial side views further illustrating the structural features of the recreational water sled.

DETAILED DESCRIPTION

Figures 1A, 1B:
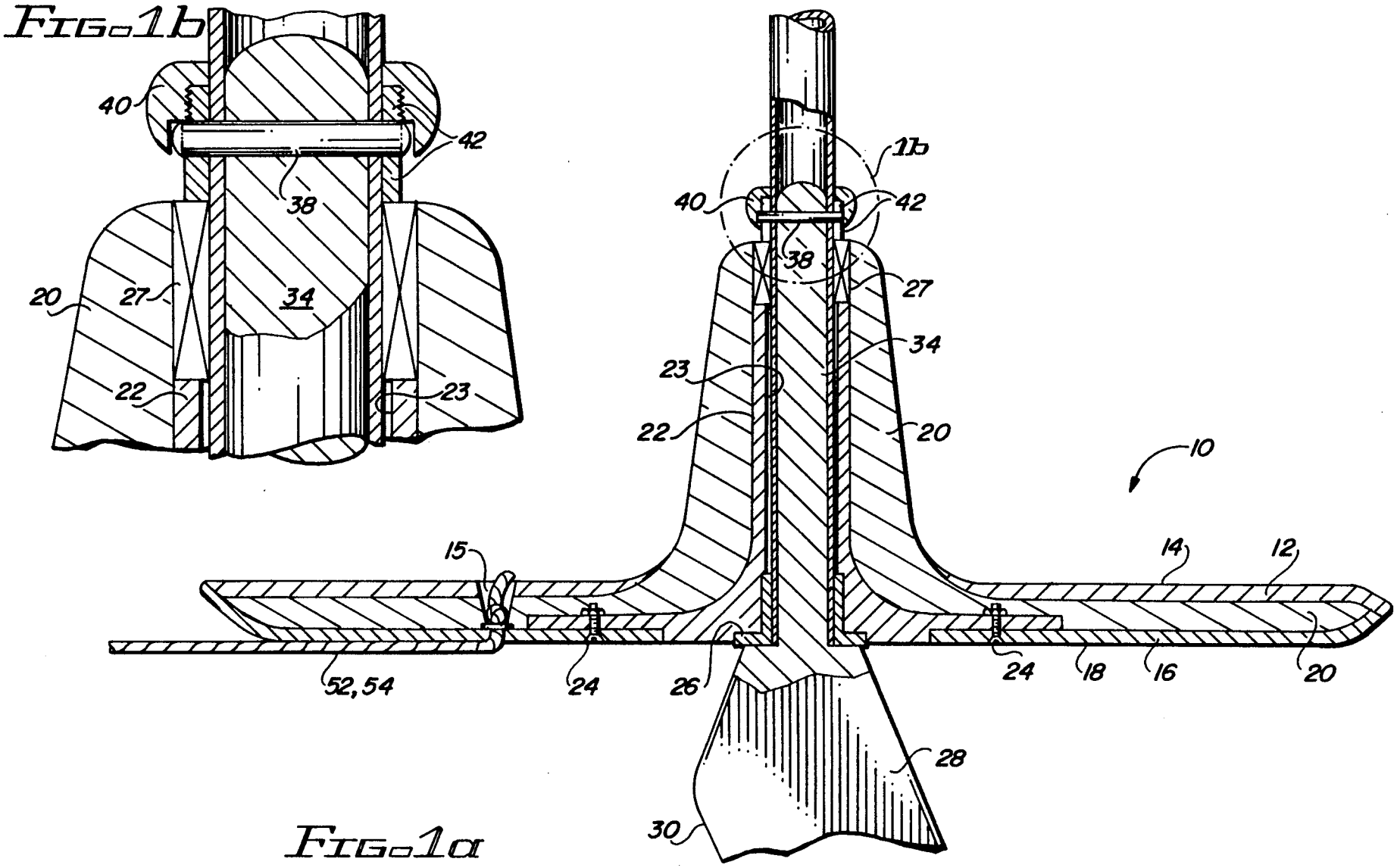

A preferred embodiment will now be described with reference to the drawings, in which reference numeral 10 refers generally to a recreational water sled in accordance with the present invention.

The water sled 10 includes a generally circular and floatable disc formed of a top and bottom sections 12, 16, each defining respective upper and lower surfaces 14, 18. It is preferred that the bottom surface 18 be flat, and free of any fixed fins, stabilizers or the like. A molded plastic stanchion 20 has a central portion which extends upwardly from the top surface 14, and another portion that extends through the center of the circular disc between sides 12 and 16 to impart flotation. An internal stiffener 22 also includes a centrally rising portion with an opening 23 therein for receiving the rudder 28, described in greater detail below. The stiffener 22 is attached via fasteners 24 to the bottom flat side 16.

The rudder 28 includes a rudder stem 34 extending upwardly through the hole 23 and rotatably supported therein by a steering pole 36 and bearings 26, 27. The rudder 28 includes a rearwardly-extending rudder surface 32, and a rearwardly slanted forward surface 30. The use of the slightly trailing rudder 28 produces a somewhat unbalanced rotational force while the water sled 10 is being turned, but is desirable as a self alignment mechanism to permit the rider to engage in "hands off" use, once a particular change of direction has been achieved.

The rudder 28 includes an upwardly-extending pin 34 which passes through the stanchion 20 and stiffener 22 via the hole 23, and extends slightly above the stanchion, as shown in FIG. 1. The steering pole 36 covers the length of and is attached to the rudder pin 34 via a threaded sleeve 42, pin 38 and pin retaining nut 40. A steering handle 44 is attached along the upper portion of the steering pole 36 via insert 46. A hub 48 is joined to the upper extremity of the steering pole 36, and includes an indentation 50 to which a portion of the towing rope, described below, is attached.

Figure 2:
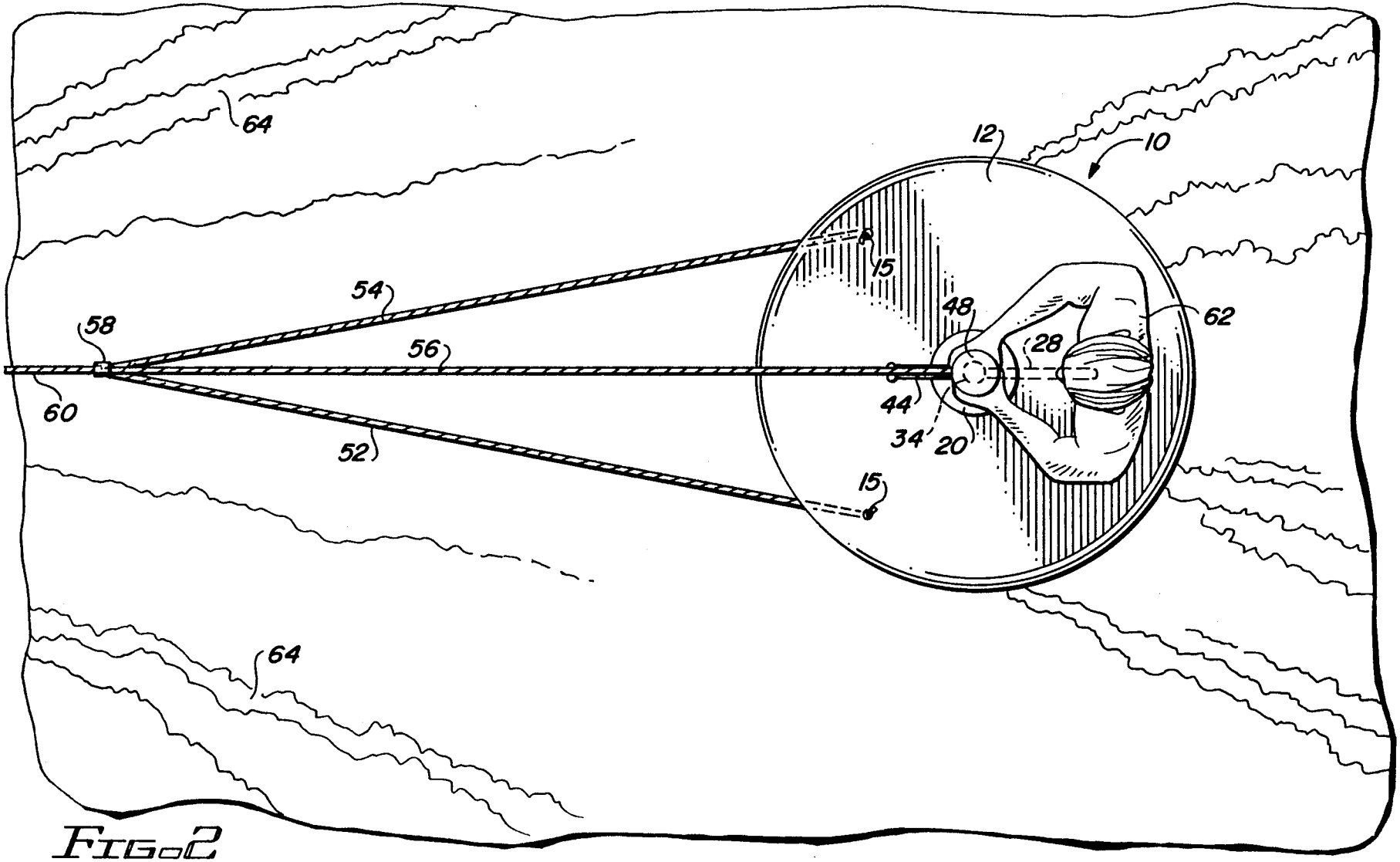
FIGS. 2 and 3 are top views of a recreational water sled in accordance with the present invention, illustrating the manner in which a rider stands upon the sled.
Figure 3:
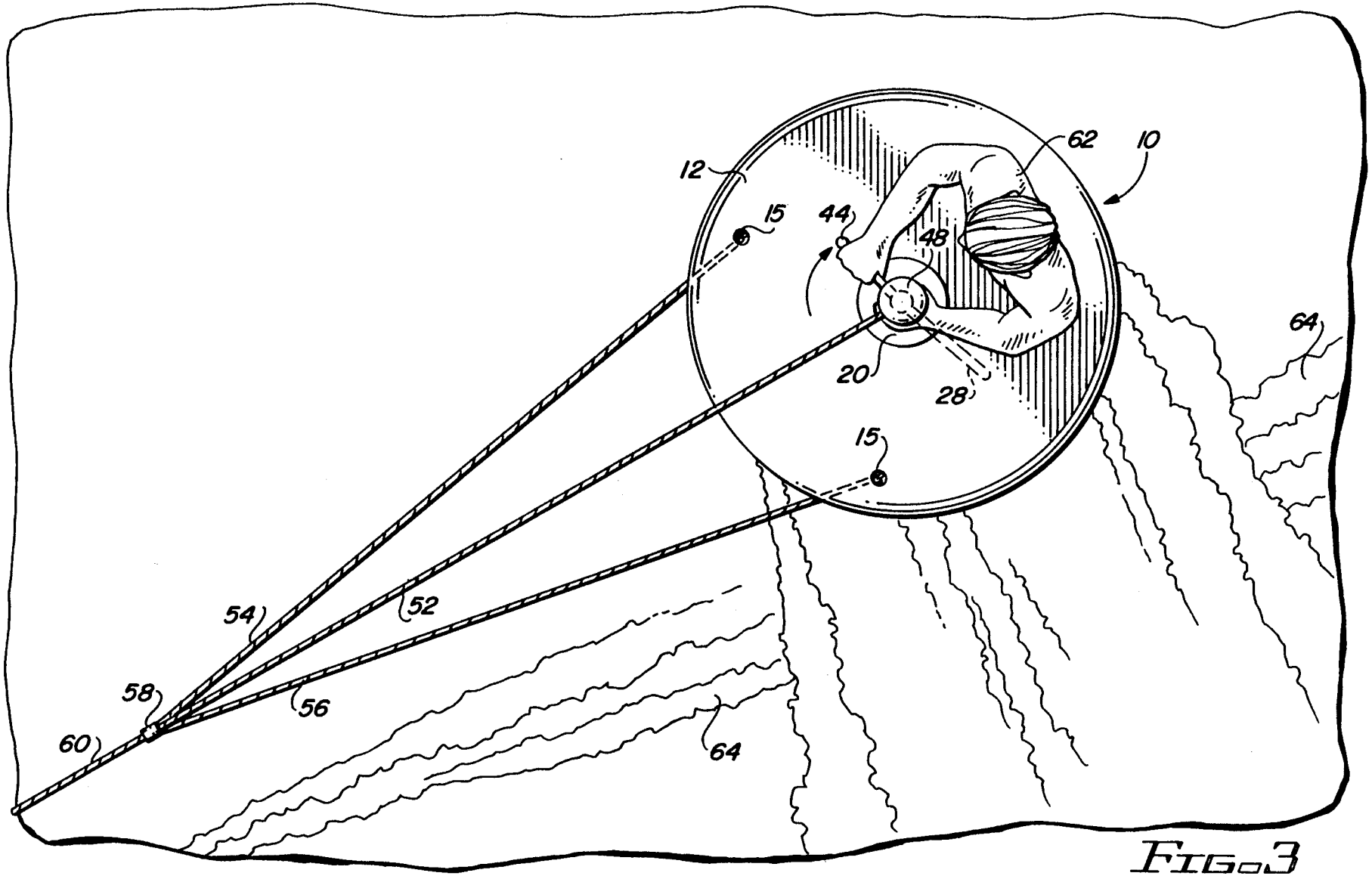

As is shown in the cross section of FIG. 1 and the top views of FIGS. 2 and 3, a tapered hole 15 extends through the disc between the upper surface 14 and the lower surface 18, and with spaced first and second tow rope sections 52 and 54 attached to the sled member through the tapered holes 15. Preferably, the tow rope sections 52, 54 extend along the flat bottom surface 18 at the forward edge of the sled member. In accordance with this invention, a third tow rope section 56 is attached at the groove 50 of the hub 48, and is joined with the first and second tow rope sections 52, 54 at a point 48 approximately 10 to 20 feet forward of the sled member. A single two rope 60 is then attached to the three tow rope sections, and is attached to a towing boat (not shown).

Figure 4:
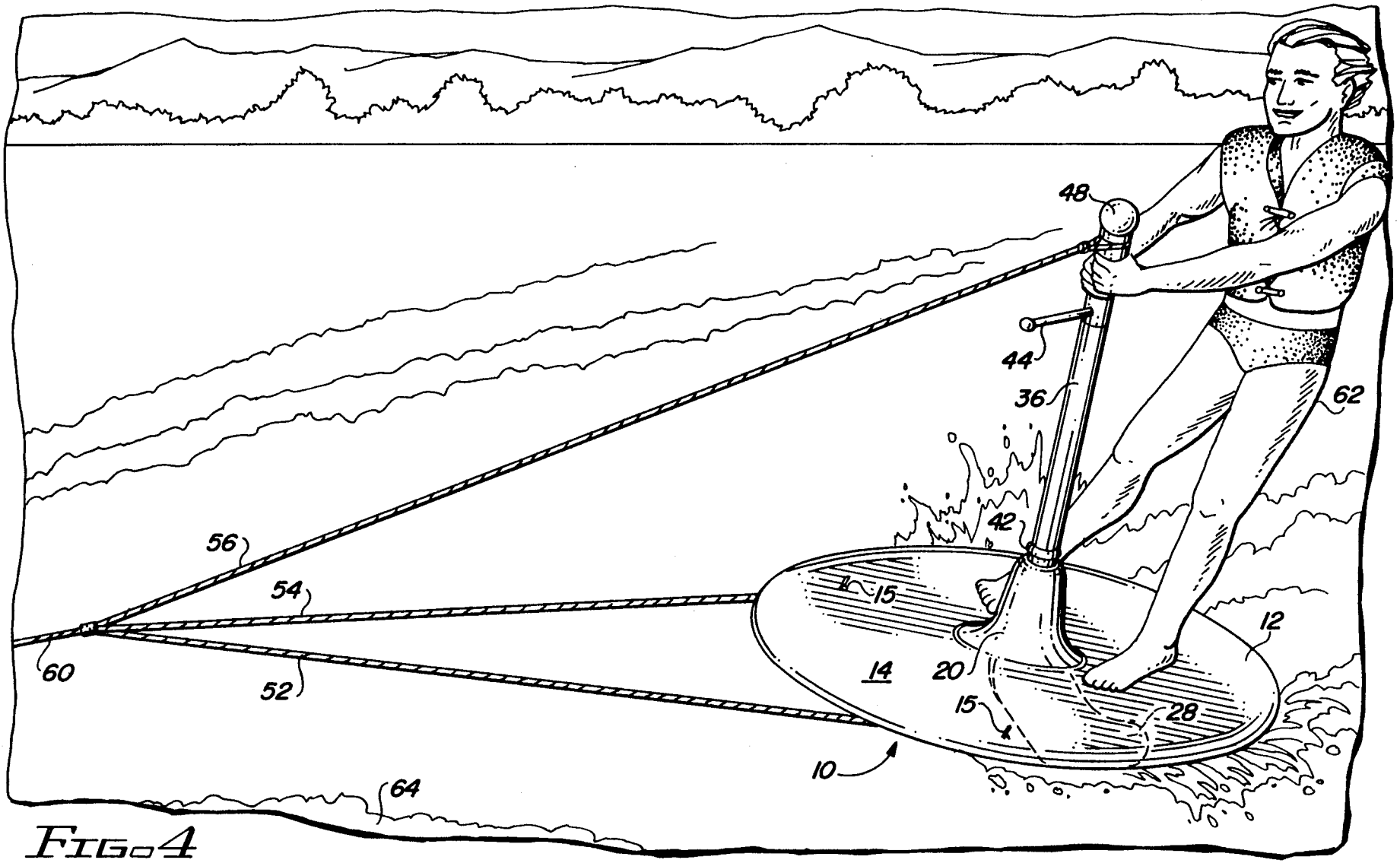
FIG. 4 is a perspective view similar to FIGS. 2 and 3, illustrating the manner in which a rider is permitted to lean backward on the water sled of the present invention.

In use, a rider 62 stands or kneels on the upper surface 14 rearwardly from the steering pole 36. If the rider 62 is standing upon the upper surface 14 before the boat begins towing the water sled 10, then the sled member most likely will be at least partially submerged. However, because of the three point attachment system for the tow rope sections 52, 54 and 56 as well as the space location of the first and second two rope sections 52, 54, then a person may stand upon the partially submerged water sled 10 even as the towing boat begins to pull the sled 10 into a planing condition, as is illustrated in FIG. 2. Thereafter, the rider 62 may easily move the water sled from side to side and across the wake 64 of the towing boat, by simply rotating the steering handle 44 sideways, thus positioning the rudder 28 in a direction to cause that sideward movement (note FIG. 3). Significantly, the construction of the water sled 10 of the present invention permits the rider 62 to lean outwardly or rearwardly with respect to the steering pole, while in the standing position, as is shown in FIG. 4. When the rider 62 does lean outwardly or rearwardly, the upper tow rope section 56 takes most of the pull, thereby providing vertical stability. Unbalanced forces which have a tendency to flip the sled or exert undue drag on the rudder are avoided, becasue the pull, drag and inertia forces all converge on the steering pole 36. This permits the sled to be guided angularly with respect to the line of pull without turning the sled.

Typically, the steering pole 36 extends to a height of approximately 5 feet above the top surface 14 of the sled member, and the steering arm 44 is attached at approximately waist height for a medium sized adult, to serve as an aid in steering. However, many rudder direction changes may be made by gripping the steering pole 36 without the use of the steering arm 44.

It will be understood by those skilled in the art that various modifications may be made in the design of the water sled described above, without departing from the spirit and scope of the present invention.

What is claimed is:

1. A recreational water sled for carrying a rider while being towed behind a boat, the sled comprising:

a generally circular sled having a relatively flat lower surface and an upper surface with a stanchion extending centrally above the upper surface and with a steering hole extending through the sled and the stanchion;

a steering pole extending generally upwardly from the stanchion hole to a height approximately at least chest high for a rider standing upon the sled with a hub at the upper extremity of the pole;

a rudder extending rearwardly adjacent to and along the bottom surface, the rudder assembled for rotation with the steering pole through the steering hole; and a three point tow rope system including first and second tow ropes attached at spaced points to the lower surface along a forward portion of the sled, and an elevated tow rope rotatably attached to the hub of the steering pole.

2. The recreational water sled recited in claim 1 wherein the steering pole extends centrally through the sled member and wherein the rudder extends rearwardly from the steering pole with respect to the towing means.

3. The recreational water sled recited in claim 1, further comprising a steering arm extending laterally from the steering pole along the upper portion thereof.

4. The recreational water sled recited in claim 1 wherein the towing means further comprises means joining the first, second and third tow rope sections together a substantial distance from the forward edge of the sled member.

5. The recreational water sled recited in claim 4 wherein the joining means is spaced from the forward edge of the sled member a distance on the order of 10–20 feet.

6. The recreational water sled recited in claim 1 wherein the sled member comprises central flotation means.

7. The recreational water sled recited in claim 1 further comprising bearing means between the stanchion and the steering pole and rudder assembly.

8. The recreational water sled recited in claim 1 wherein the steering pole and rudder comprise the steering pole formed of a tube;

the rudder including a pin extending through the stanchion and into the steering pole tube; and means for fixing the rudder pin to the steering pole tube so that both rotate together.

9. The recreational water sled recited in claim 1 wherein the sled member is formed of a high impact plastic having a hollow core, with a flotation foam contained within the core.

10. A method for towing a recreational water sled behind the boat, comprising the steps of:

providing a water sled having a generally planar member for supporting a rider, and an upstanding pole extending generally upwardly with respect to the planar member to approximately shoulder height with respect to the rider;

attaching a first tow rope section to the planar member;

attaching a second tow rope section to a hub for rotation about the upstanding pole an elevated distance above the planar member;

attaching a third tow rope section to the planar member at a point spaced from the first tow rope section; and towing the sled through the water by attaching the first, second and third tow rope sections to a boat, while the rider is positioned on the planar member.

11. The method recited in claim 10 further comprising the step of steering the planar member by rotating the upstanding pole.

12. The method recited in claim 11 further comprising the step of centering the upstanding pole in the planar member.

* * * * *